United States Patent [19]
Rampe
[11] 4,287,872
[45] Sep. 8, 1981

[54] METHODS AND APPARATUS FOR DUCTLESSLY DISTRIBUTING AND CIRCULATING HEATED AIR FROM A GAS-FIRED HEATER TO HEAT LARGE VOLUMES OF AIR IN INDUSTRIAL FACILITIES

[75] Inventor: John F. Rampe, Mayfield Heights, Ohio

[73] Assignee: Rampe Research, Cleveland, Ohio

[21] Appl. No.: 82,115

[22] Filed: Oct. 5, 1979

[51] Int. Cl.[3] ..... F24H 3/02
[52] U.S. Cl. ..... 126/110 D; 237/46; 165/122; 98/33 A
[58] Field of Search ..... 237/53, 50, 46; 165/122; 98/33 A; 126/110 D, 110 P, 110 A, 110 R; 236/49

[56] References Cited

U.S. PATENT DOCUMENTS

| | | | |
|---|---|---|---|
| 1,719,659 | 7/1929 | Hopkins | 237/46 |
| 3,246,643 | 4/1966 | Stark et al. | 98/33 A |
| 4,103,146 | 7/1978 | Rampe | 165/122 |

*Primary Examiner*—Albert J. Makay
*Assistant Examiner*—Henry Bennett
*Attorney, Agent, or Firm*—Burge & Porter Co.

[57] ABSTRACT

An apparatus for ductlessly distributing and circulating heated air from a gas-fired heater to heat large volumes of air in industrial facilities and the like includes an upstanding structure which defines a vertically extending chamber. Openings are provided in lower and upper portions of the structure and communicate the chamber with lower and upper strata of ambient air. A blower assembly is housed within the structure intermediate the lower and upper openings. A gas-fired heater is carried by the structure externally of the chamber. Heated air from the gas-fired heater unit discharges into the chamber at a location between the lower and upper openings and combines with air being circulated by the blower in an upwardly directed flow through the chamber. The lower and upper openings are arranged such that air from the lower strata is drawn toward the lower openings, and such that air discharging from the upper openings into the upper strata moves outwardly toward the walls of the room. The effect of this type of operation is to establish a substantially toroidal air flow circulation about the apparatus which promotes a thorough intermixing of air from all parts of the room and promotes temperature uniformity throughout the room.

3 Claims, 3 Drawing Figures

METHODS AND APPARATUS FOR DUCTLESSLY DISTRIBUTING AND CIRCULATING HEATED AIR FROM A GAS-FIRED HEATER TO HEAT LARGE VOLUMES OF AIR IN INDUSTRIAL FACILITIES

CROSS REFERENCE TO RELATED PATENT

U.S. Pat. No. 4,103,146 issued July 25, 1978 entitled "Methods and Apparatus for Ductlessly Circulating and Selectively Supplementally Heating Large Volumes of Air in Industrial Facilities," hereafter referred to as the "Toroidal Air Flow Circulation Patent," the disclosure of which is incorporated herein by reference.

BACKGROUND OF THE INVENTION

1. Field of the Invention

The present invention relates to methods and apparatus for ductlessly distributing and circulating heated air from a gas-fired heater to heat large volumes of air in industrial facilities and the like.

2. Prior Art

Industrial facilities including warehousing, fabrication, machining and assembly areas typically have relatively high ceilings to accommodate the operation of hoists, lift trucks, overhead conveyors and other industrial equipment. Heated air rises and accumulates near high ceilings. While a heating system is laboring to maintain 65° F. at body level in a high-ceilinged room, ceiling temperature may reach 88° F. or above. Most heating systems do little to return ceiling air into body level circulation, and as such, the high temperature ceiling air represents a substantial loss of energy.

Proposals have been made to heat warehouses and other large industrial buildings with ductless furnaces positioned along walls or near corners of the building. One furnace proposed for such use has a modular construction including a lower intake section, an intermediate heater section, and an upper discharge section. One drawback of the proposed furnaces is that their being positioned near walls or in a corner of the room they serve inhibits their drawing ceiling air efficiently into circulation. Another drawback is that air inlet and discharge openings are not provided around the entire periphery of the inlet and discharge sections to permit an efficient, radially directed intake and discharge of air. The non-radially directed intake and discharge flow paths that result due both to the configuration of the intake and discharge sections and due to the positioning of proposed furnaces along walls or in corners, provides inefficient air circulations that often do not reach all portions of the rooms being heated and are readily disturbed by obstructions such as columns, low partitions, and nearby machinery.

A problem commonly encountered in industrial facilities is that activities conducted in different areas are subject to change as demand increases and decreases for certain types of products and services. While activities conducted in an area of an industrial facility may change relatively substantially, it is unusual for accommodating changes to be made in the area's heating system. Heating systems are ordinarily permanently installed and, while their outputs can be controlled within a range to provide some accommodation for a change in heat demand, such systems seldom include provisions to enhance air circulation in and provide supplemental comfort heating for specific areas where activities are temporarily concentrated.

Portable heaters of various types have been proposed to supplement the operation of existing heating systems. A drawback of such proposals is their inability to gently and effectively circulate large volumes of air in a designated area. Proposed portable heaters are expensive to operate and tend to provide an uncomfortable working atmosphere with hot air concentrated near the heaters and with a substantially colder air environment only a few feet away. Where proposed portable heaters have relatively large air circulating capabilities, they have typically been noisy in operation and provide directional high velocity heated air outputs that are objectionable. Moreover, proposed portable heaters do practically nothing to bring high temperature ceiling air back into circulation.

THE REFERENCED PATENT

The referenced Toroidal Air Flow Circulation Patent addresses the foregoing drawbacks of the prior art by providing methods and apparatus for efficiently, ductlessly, circulating and selectively supplementally heating large volumes of air in industrial facilities and the like. In the preferred practice of the invention described in the referenced patent, an air circulating apparatus includes an upstanding structure which defines a vertically extending chamber. Openings are provided in lower and upper portions of this structure and communicate the chamber with lower and upper ambient air strata. A blower assembly is housed within the structure intermediate the lower and upper openings. The lower and upper openings are arranged such that, when the blower assembly is operated to move air upwardly within the chamber, air from the lower strata is drawn substantially radially inwardly toward the lower openings, and air discharging from the upper openings into the upper strata moves substantially radially outwardly toward the walls of the room.

As is explained in the referenced patent, the lower openings preferably extend around the entire periphery of the lower end region of the upstanding structure from floor level to the height of about 2 to 3 feet above floor level. The upper openings preferably extend around the entire periphery of the upper end region of the upstanding structure in a 2 to 3 foot wide band located about 6 to 10 feet above floor-level. This arrangement of openings promotes the movement of a 2 to 3 foot thick blanket of lower strata air radially inwardly toward the lower openings, and the movement of a 2 to 3 foot thick blanket of upper strata air radially outwardly from the upper openings. The moving blanket upper strata air descends as it approaches the walls of the room to replace air moving radially inwardly in the lower strata air blanket. The result is a donut-shaped or toroidal "primary" air flow circulation.

The primary circulation torus operates to induce a "secondary" air flow circulation in the space above the apparatus. A secondary flow is induced by virtue of the fact that flowing air in the primary circulation torus has a lesser pressure than static air. The principle that pressure of a flowing fluid diminishes as flow velocity increases is known to those skilled in the art as Bernoulli's Theorem.

As air discharges at a relatively fast velocity from the upper openings, it has a noticeably reduced pressure. The reduced pressure profile of air which discharges from the apparatus and which forms the upper strata air blanket causes overhead air to be drawn downwardly toward the "primary" circulation torus, and to travel radially outwardly with upper strata air in the "primary" torus. The result is the induced establishment of an overhead "secondary" air circulation flow that is of substantially toroidal shape. The "primary" and the "secondary" torri operate to effect a thorough intermixing of air from overhead, upper and lower strata, whereby a more uniform temperature is established at all stratas.

Stated in another way, a significant advantage of the invention described in the referenced patent is that it provides a simple and inexpensive method of reclaiming heat that would otherwise be lost due to the accumulation of light density heated air along high-ceilinged areas of an industrial facility. By establishing a primary air flow torus at a lower level which induces the formation of a secondary air flow torus at a higher level, air from all strata of a high-ceilinged room can be effectively and efficiently commingled and circulated to promote temperature equalization at all levels. By retrieving lost heat from overhead strata, heating costs can be substantially reduced. By effectively commingling and circulating air throughout the industrial facility, pockets of uncomfortably hot and cold air are dissipated and working conditions are substantially improved.

In the preferred practice of the invention described in the referenced patent, the apparatus is portable and its upstanding structure is provided by a stacked array of lower, intermediate and upper modules or sections. The modules or sections are releasably connected one atop another and form an upstanding structure of substantially parallelepiped configuration. The lower and upper modules have sidewalls that are perforated around substantially their entire perimeters to define the described lower and upper openings. An intermediate module or modules have solid sidewalls, house the blower assembly, and may also house a heater assembly.

Where a heater assembly is provided in the practice of the invention of the referenced patent, it is provided within an intermediate section of the apparatus at a location extending across the flow path of air moving upwardly through the vertical chamber. The referenced patent describes an electrical heater assembly which can be energized when required to supplementally heat the circulating air. The heater unit preferably comprises a plurality of resistance heating elements which are selectively energized as needed. The heating elements extend across the path of travel of air discharging from the blower and, as such, require a specially configured support to position them within the path of flow of air discharging from the blower.

While the electrical heater system described in the referenced patent is entirely operable and works quite well to provide primary or supplemental heating in an industrial facility, the heater unit is relatively costly to produce in that it requires a non-conventional mounting with attendant wiring the controls. Moreover, in many regions of the country, electrical heating costs are substantially greater than costs which would be incurred if gas-fired heaters could be used in place of electrically energized heaters.

Attempts to provide the apparatus described in the referenced patent with a heating source other than electric resistance heaters have included the fitting of the apparatus with heat exchanger coils whereby steam can be circulated through the path of air flow discharging from the blower. While this approach is also effective in providing an operable unit, the cost of providing specially configured heat exchanger oils and attendant plumbing is unduly high.

While efforts have been made to provide the apparatus described in the referenced patent with a gas-fired burner, it has been assumed that the burner needs to be positioned in the chamber in the path of air flow moving upwardly under the influence of the blower. This assumption has lead to prototypes that are unduly complexly configured, and has not produced a viable, operable system.

SUMMARY OF THE INVENTION

The present invention overcomes the foregoing and other drawbacks of the prior art by providing novel and improved methods and apparatus for effectively, ductlessly, distributing and circulating heated air from a gas-fired heater to heat large volumes of air in industrial facilities and the like. The system of the present invention utilizes an apparatus of the general type described in the referenced Toroidal Air Flow Circulation Patent in combination with a conventional gas-fired heater unit.

In accordance with the preferred practice of the present invention, an apparatus of the general type described in the referenced Toroidal Air Flow Circulation Patent is provided with a conventional gas-fired heater unit mounted on one side of the air flow circulation apparatus at a location external of the vertical chamber for discharging heated air into the vertical chamber. Heated air from the heater unit combines with such air being moved upwardly through the chamber by the blower. The combined air flow travels upwardly through the chamber and circulates substantially radially outwardly from the apparatus through the upper level openings to provide the same type of toroidal air flow patents which result from the practice of the invention of the referenced patent.

An apparatus of the type embodying the preferred practice of the present invention provides a means for dramatically increasing the efficiency of operation of a gas-fired heater unit. Whereas a gas-fired heater unit would ordinarily discharge hot air in a substantially unidirectional flow path, the present invention provides a means of distributing heated air from a gas-fired heater unit throughout a relatively large room of an industrial facility. The system of the present invention is well adapted for use as either a primary or as a supplemental heater for a large facility, and can be used in combination with heaters already installed in the facility to significantly improve their performance.

Whereas the apparatus described in the referenced Toroidal Air Flow Circulation Patent employs a specially configured heater unit located within the path of air flow discharging from a blower, the system of the present invention utilizes a conventional gas-fired heater unit positioned at one side of the air flow path. By this arrangement, a relatively inexpensive gas-fired heater of conventional construction can be employed to discharge heated air into the air flow path for combination with air being circulated by the apparatus from within the facility.

These and other features and a fuller understanding of the invention may be had by referring to the following description and claims taken in conjunction with the accompanying drawings.

DESCRIPTION OF THE PREFERRED EMBODIMENT

Figure 1:
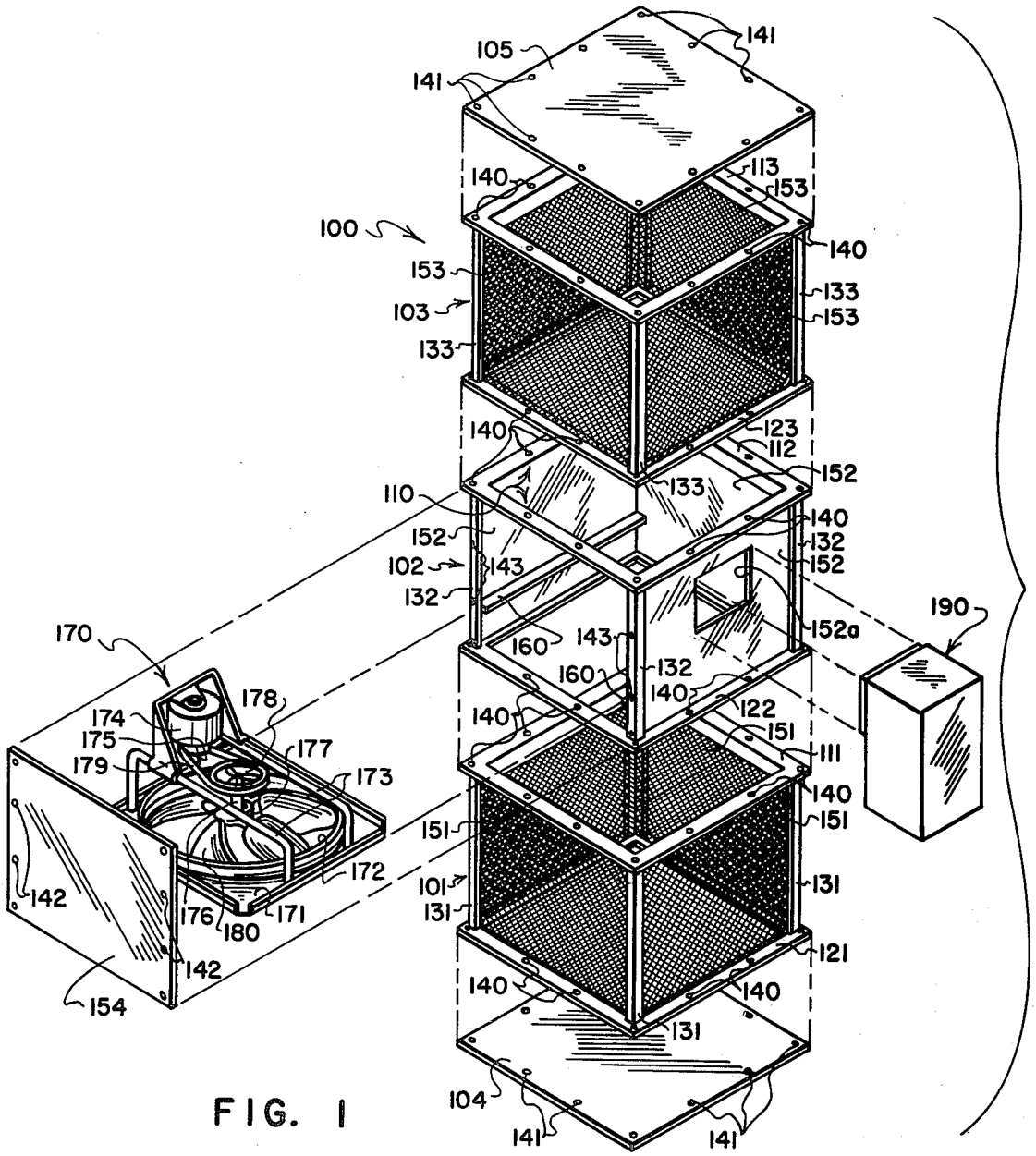
FIG. 1 is an exploded perspective view of an apparatus embodying the preferred practice of the present invention.
Figure 2:
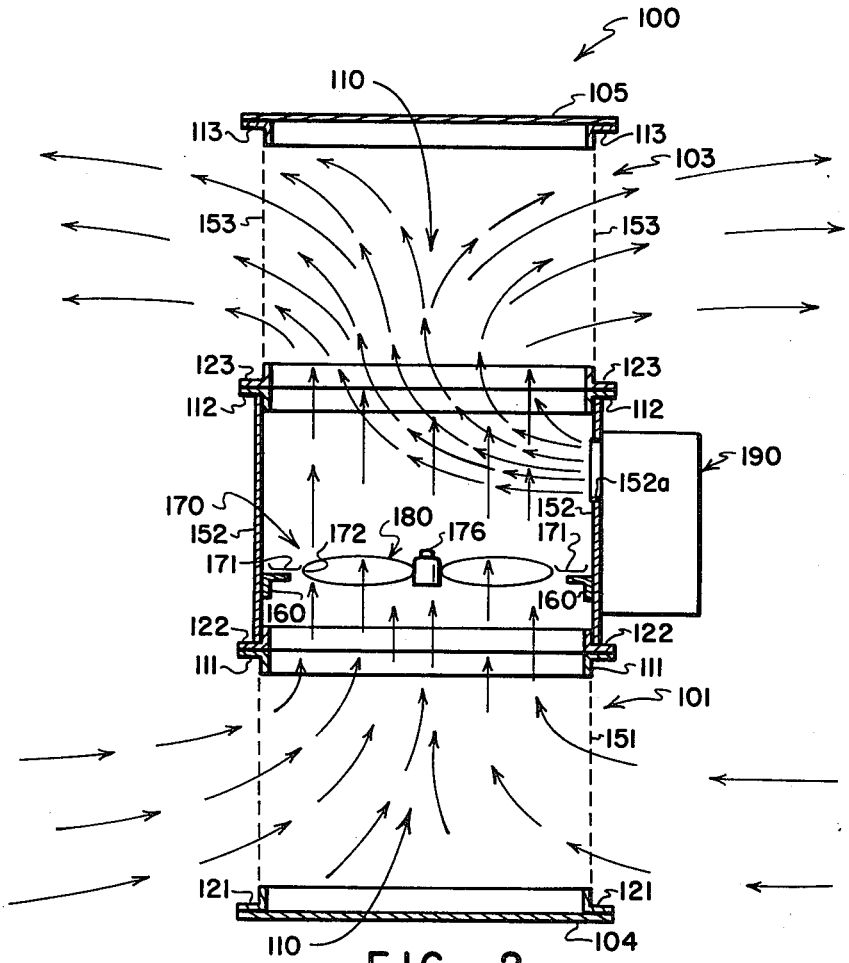
FIG. 2 is a schematic sectional view of the preferred apparatus embodiment; and, FIG. 3 is a schematic elevational view of an industrial facility illustrating air flow circulations established in accordance with the methods of the present invention.

Referring to FIGS. 1 and 2, an apparatus embodying the preferred practice of the present invention is indicated generally by the numeral 100. The apparatus 100 includes lower, intermediate and upper sections or modules 101, 102, 103 supported one atop the other and defining a vertically extending chamber 110. Each of the sections 101, 102, 103 is of substantially right parallelepiped construction with corners and edges defined by welded frameworks of angle iron. A bottom plate 104 may be provided to cover the open bottom end of the lower section 101, or the apparatus 100 may simply be positioned on a floor with the floor closing the bottom end of the lower section 101. A top plate 105 closes the open top end of the upper section 103.

The welded angle iron frameworks for the sections 101, 102, 103 are identical and include upper rectangular frames 111, 112, 113, lower rectangular frames 121, 122, 123, and interconnecting upstanding corner members 131, 132, 133. Horizontally extending flanges of the upper and lower frames 111, 112, 113, 121, 122, 123 are drilled at spaced locations to provide aligned bolt holes 140. The bottom and top plates 104, 105 are also drilled at spaced locations to provide aligned bolt holes 141. Bolts (not shown) are inserted in the bolt holes 140, 141 and are secured by lock washers and nuts (not shown) to hold the sections 101, 102, 103 together and to secure the bottom and top plates 104, 105 on the lower and upper sections 101, 103.

The lower and upper sections 101, 103 have four sidewalls 151, 153 formed from expanded metal screen material. The expanded metal screens provide lower and upper openings extending around the lower and upper end regions of the apparatus 100. The expanded metal sidewalls 151, 153 are welded to the frameworks of the lower and upper sections 101, 103 and provide inlets and outlets, respectively, for air to enter and discharge from the chamber 110.

The intermediate section 102 has three upstanding sidewalls 152 formed from sheet metal and welded to the framework of the intermediate section 102. An opening **152*a* is provided through one of the sidewalls 152. A fourth side of the intermediate section is provided with a removable sidewall door 154 positioned alongside with framework of the intermediate section 102 to close the open side of the intermediate section 102. Aligned bolt holes 142, 143 are provided in the door 154 and in the framework of the intermediate section 102. The framework holes 143 are threaded to receive bolts (not shown) that are slip-fitted through the door holes 142**.

A pair of horizontally extending angle iron brackets 160 are welded inside the framework of the intermediate section 102. An electric blower assembly 170 is provided for positioning atop the brackets 160. The blower assembly 170 includes a base plate 171 of rectangular configuration which is adopted for insertion through the open side of the intermediate section 102 to a position where it rests atop and is supported by the brackets 160. A round hole 172 is formed centrally through the base plate 171. A pair of U-shaped tubular rails 173 are secured to opposite sides of the base plate 171 and extend in parallel spaced relationship over the hole 172.

An electric motor 174 is mounted near one end of the rails 173. A drive pulley 175 is carried on the drive shaft of the motor 174. A vertically extending shaft 176 is journaled by a bearing assembly 177. The bearing assembly 177 is mounted on the rails 173 at a location centrally above the hole 172. A pulley 178 is carried on the upper end region of the shaft 176. A drive belt 179 is reeved around the pulleys 175, 178 to drivingly interconnect the motor 174 and the shaft 176.

A fan 180 is supported on the lower end region of the shaft 176. The motor 174 is wired such that when it is supplied with electricity, it will rotate the fan 180 to draw air inwardly through the sidewalls of the lower section 101, blow air upwardly through the chamber 110, and discharge air through the sidewalls of the upper section 103.

A conventional gas-fired heater unit 190 is mounted on one side of the apparatus 100 at one side of the chamber 110 for discharging heated air into the chamber 110 at a location between the lower and upper section openings. The heater unit 190 has its own enclosed blower for discharging heated air into the chamber 110 through the sidewall opening **152*a*. The front of the heater 190 is mounted just outside the sidewall opening 152*a* and the heater unit 190 is suitably attached to the framework of the apparatus 100. Hot air discharging from the heater 190 discharges at substantially a right angle to the path of air moving upwardly through the chamber under the influence of the blower 170, as indicated schematically by arrows in FIG. 2. The hot air from the heater 190 combines with the flow of air moving upwardly under the influence of the blower 170 to provide a heated combined flow which discharges outwardly from the apparatus 100** through the upper module sidewall openings.

A significant feature of the apparatus 100 is its simple, lightweight, modular construction which permits the apparatus to be transported easily from place to place within an industrial facility. The modules or sections 101, 102, 103 preferably have dimensions of about 36 inches in height and 44 by 44 inches in length and width, with the fan 180 being about 36 inches in diameter. As such, the apparatus 100 has a capability for circulating large volumes of air in a gentle and quiet fashion that in no way disturbs the chores of nearby workers. Wheels can be added to the lower section 101, as indicated by the numeral 230 in FIG. 3, to facilitate moving the apparatus 100 in the event that areas of work concentration change from room to room in an industrial facility.

An additional feature of the apparatus 100 is that it increases the efficiency of existing heating equipment by providing a thorough mixing the recirculation of air which inhibits the collection of stagnant pockets of heated air near high ceilings. A substantial fuel savings has been found to result in the operation of conventional heaters where the apparatus 100 has been used simply to better circulate the air heated by the conventional heaters.

Figure 3:
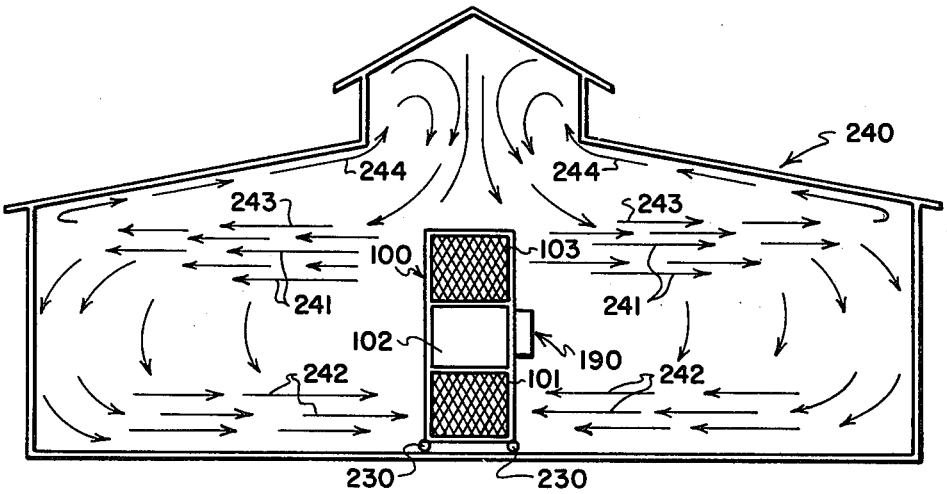

The circulation paths followed by air in moving through the apparatus 100 are indicated by arrows in FIG. 3. A "stratified" circulation results with lower strata air being drawn substantially inwardly in a 2 to 3 foot thick lower blanket toward the apparatus 100. Air discharged from the apparatus tends to disperse substantially outwardly in a 2 to 3 foot thick upper strata blanket, and return, once it has cooled and descended to the lower strata.

Referring to FIG. 3, a room in industrial facility or the like is indicated generally by the numeral 240. The apparatus 100 is preferably positioned substantially centrally in the room 240. In operation, air discharging from the apparatus 100 tends to travel substantially radially outwardly from the upper section 103 toward the walls of the room 240 in an upper strata blanket, as indicated by arrows 241. At the same time, air is drawn from a lower strata substantially radially inwardly in a lower strata blanket toward the lower section 101, as indicated by arrows 242. The "primary" air circulation flow which results, when viewed in three dimensions, is of substantially toroidal or doughnut shape.

Air flowing in the upper blanket of the primary torus, as indicated by the arrows 241, has a lesser pressure than does static air above it. This phenomenon is explained in Bernoulli's Theorem which states that the pressure of a flowing fluid is reduced as the speed of flow is increased. The reduced pressure of air in the upper strata blanket helps to induce the establishment of an overhead "secondary" air flow circulation, as will now be described.

Air flowing in the upper strata radially outwardly from the upper section 103 has its highest velocity, and hence its lowest pressure, adjacent the upper section 103. As air in the upper strata travels radially outwardly from the upper section 103 it disperses and diminishes in velocity, whereby its pressure gradually approaches that of ambient static air. The substantially reduced pressure of air near the upper section 103 causes overhead air to circulate downwardly from levels near the highest ceilinged part of the room 240 and toward the apparatus 100.

The overhead air which circulates downwardly commingles with air in the upper strata, and flows radially outwardly from the upper section 103 as indicated by arrows 243. The air drawn down from high ceilinged areas is replaced by other overhead air drawn into circulation as indicated by arrows 244. The overhead circulation which is induced in this manner has a configuration that is dependent on ceiling configuration and other factors, but can, for the sake of simplicity, be described as a "secondary" upper torus having an air flow direction which is opposite to that of the lower "primary" torus.

The apparatus 100 having a height of about 9 feet and a blower capacity for circulating about 1300 cubic feet of air per minute will adequately serve a room of 8,000 to 12,000 square feet having ceilings of average industrial height. If the floor area is substantially larger or the ceilings are much higher than normal, a plurality of the apparatuses 100 can be used at spaced, central locations in the room. The apparatuses should have a capability for recirculating air from 2 to 4 times per hour in order to adequately promote temperature uniformity throughout the room.

The heater 190 preferably has a capacity of introducing about 3,200 cubic feet of air per minute at a temperature of 160° F. into the chamber 110. If air from the facility being heated is brought into the apparatus 100 at a rate of about 13,000 cubic feet per minute at a temperature of about 60° F., this will combine with the heated air entering the chamber 110 from the heater 190 to provide air discharging through the sidewall openings of the upper module 103 at the rate of about 16,200 cubic feet per minute at a temperature of about 80° F.

One of many commercially available heater units suitable to perform as the gas-fired heater unit 190 is sold by Empire Stove Company of Belleville, Ill. 62222 under the model designation 250DUF, having a BTU input per hour of 250,000, a BTU output per hour of 200,000 and delivering 3190 cubic feet of air per minute at about 160° F.

Although the invention has been described in its preferred form with a certain degree of particularly, it is understood that the present disclosure of the preferred form has been made only by way of example and numerous changes in the details of construction and a combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. An apparatus for heating, circulating and dispersing air in industrial building facilities and the like, comprising:

(a) an upstanding structure of substantially right parallelepiped configuration including an assambly of lower, intermediate and upper modules arranged one atop the other and secured together to define a substantially unobstructed vertical chamber extending through the assembled modules;

(b) each of the modules having a framework which defines upper and lower mounting flanges extending perimetrically in horizontal planes near upper and lower ends of their associated modules;

(c) the upper and lower mounting flanges of adjacent modules being releasably connected to releasably interconnect the modules;

(d) closure means closing the upper end of the upstanding structure;

(e) each of the modules additionally having four substantially rectangular sidewalls secured to their associated framework, each of the sidewalls of the upper and lower modules having a plurality of apertures formed therethrough to facilitate the passage of air therethrough, and the sidewalls of the intermediate module being substantially impervious to inhibit the passage of air therethrough with the exception of one of the intermediate module sidewalls having an opening formed therethrough for receiving heated air being discharged from a gas-fired heater;

(f) a heater positioned externally of said one intermediate module sidewall so as to avoid obstruction to said chamber and mounted thereon, said heater having gas-fired means for heating air drawn externally of said modules into said heater from within said industrial facility for discharging heated air through said intermediate sidewall opening into the intermediate module for combining with and augmenting air passing vertically through the chamber; and, (g) an electrical blower assembly disposed in said vertical chamber at a location between the upper and lower module apertures and including a fan for drawing ambient air through the apertured lower module sidewalls, for ducting such air upwardly through the chamber for combination with heated air being discharged into the chamber by the gas-fired heater, and for discharging such combined air through the apertured upper module sidewalls.

2. The apparatus of claim 1 wherein said apertured sidewalls in said upper and lower modules each have a height of from about 2 to 3 feet to draw in and discharge air in quantities and velocities sufficient to establish a generally toroidal flow of air when the apparatus is centrally positioned in the industrial facility.

3. The apparatus of claims 1 or 2 wherein the lower module is provided with wheels to aid in locating the apparatus in a desired location in the facility.

* * * * *

UNITED STATES PATENT AND TRADEMARK OFFICE

CERTIFICATE OF CORRECTION

PATENT NO. : 4,287,872

DATED : September 8, 1981

INVENTOR(S) : John F. Rampe

It is certified that error appears in the above-identified patent and that said Letters Patent are hereby corrected as shown below:

Column 3, line 59, cancel "the" and substitute --and--

Column 4, line 3, cancel "oils" and substitute --coils--

Column 4, line 39, cancel "patents" and substitute --patterns--

Column 6, line 60, cancel "the" and substitute --and--

Signed and Sealed this

*Ninth* Day of *February 1982*

[SEAL]

*Attest:*

GERALD J. MOSSINGHOFF

*Attesting Officer*

*Commissioner of Patents and Trademarks*